US005777882A

United States Patent [19]

Salgado

[11] Patent Number: 5,777,882

[45] Date of Patent: Jul. 7, 1998

[54] CONTROL SYSTEM FOR MAILBOXING ARRANGEMENT

[75] Inventor: David L. Salgado, Victor, N.Y.

[73] Assignee: Xerox Corporation, Stamford, Conn.

[21] Appl. No.: 721,520

[22] Filed: Sep. 26, 1996

[51] Int. Cl.[6] ..... B65H 39/10

[52] U.S. Cl. ..... 364/478.02; 271/288; 271/298; 270/52.03

[58] Field of Search ..... 364/478.01, 478.02; 270/52.01, 52.03; 271/288, 290, 298

[56] References Cited

U.S. PATENT DOCUMENTS

| | | | |
|---|---|---|---|
| 5,308,058 | 5/1994 | Mandel et al. | 271/297 |
| 5,328,169 | 7/1994 | Mandel | 271/290 |
| 5,342,034 | 8/1994 | Mandel et al. | 270/53 |
| 5,358,238 | 10/1994 | Mandel et al. | 271/298 |
| 5,435,544 | 7/1995 | Mandel et al. | 271/298 |
| 5,547,178 | 8/1996 | Costello | 270/52.02 |
| 5,551,686 | 9/1996 | Sanchez et al. | 271/298 |
| 5,603,492 | 2/1997 | Mandel et al. | 270/58.09 |

*Primary Examiner*—Emanuel Todd Voeltz
*Assistant Examiner*—Richard H. Musgrove
*Attorney, Agent, or Firm*—Gary B. Cohen

[57] ABSTRACT

A control system for a sheet handling system having a mailboxing system with a mailbox bin subsystem is provided. The mailbox bin subsystem includes a print receiving bin set with a plurality of print receiving bins, the plurality of print receiving bins being corresponded with a set of bin users. The control system includes a user interface with which one or more print receiving bins of the plurality of print receiving bins are assigned to one of the bin set users, and a controller communicating with the mailbox bin subsystem. In practice the controller: (1) determines, for the one bin set user, a frequency of use value varying as a function of a degree to which the one bin set user uses the one or more print receiving bins to which the one bin set user is assigned, and (2) reassigns one of the one or more print receiving bins to which the one bin set user is assigned when the frequency of use value drops below a preselected threshold and a selected condition is met.

32 Claims, 11 Drawing Sheets

| | | | |
|---|---|---|---|
| Bin 1 | Private | Paul | |
| Bin 2 | Public | | |
| Bin 3 | Semi-Private | Dave<br>Kim<br>Barry | |
| Bin 4 | Private | OPEN | |
| Bin 5 | Private/Semi-Private | Conditional | Private for John<br>Semi-Priv. for:<br>⋮ |

| Assignment |
|---|
| Add/Delete Name |
| Impose Condition |

302

300

User Profile db

| User Profile No. | User Name | JFV | JFT | PCV | PCT | Warn. | Bins |
|---|---|---|---|---|---|---|---|
| 1 | John | 23 | 20 | 85 | 80 | – | 11,14 |
| 2 | Jane | 21 | 30 | 110 | 120 | 1 | 17,22,29 |
| 3 | Don | 5 | – | 32 | 30 | – | 31 (Level 1) |
| 5 | Sam | – | NA | – | NA | – | 37 (Level 1) |
| ⋮ | ⋮ | ⋮ | ⋮ | ⋮ | ⋮ | ⋮ | ⋮ |
| N | Open | | | | | | |

309

Threshold Matrix

| Bin Priority Level | 1 Bin | 2 Bins | 3 Bins | ··· | N Bins |
|---|---|---|---|---|---|
| Level 1 [Most Exclusive] | 60 | 80 | 120 | ··· | TBD |
| Level 2 [Less Exclusive] | 30 | 41 | 56 | ··· | TBD |
| ⋮ | ⋮ | ⋮ | ⋮ | ⋱ | ⋮ |
| Level N [Least Exclusive] | 0 | 0 | 0 | ··· | 0 |

344

UP (4)

| t (2 wk ints) | 1 | | 2 | | 3 | | 4 | |
|---|---|---|---|---|---|---|---|---|
| Bin Type | P | SP | P | SP | P | SP | P | SP |
| Alloted Bin(s) | 2 | 1 | 2 | 1 | 2 | 1 | – | – |
| PCV | 110 | | 115 | | 118 | | NA | |

FIG. 10

CONTROL SYSTEM FOR MAILBOXING ARRANGEMENT

CROSS REFERENCE TO D/95381 & D/96440

The Present Application is related in subject matter to and cross-referenced with both U.S. patent application Ser. No. 08/(Attorney's Docket No. 95381) (entitled Document Job Routing System For A Printing System) and U.S. patent application Ser. No. 08/(Attorney's Docket No. 96440) (entitled Sheet Delivery Control System), both of which applications are attributable to the same Applicants as the Present Application, and both of which applications were filed on the same day as the Present Application.

BACKGROUND

This invention relates generally to a sheet handling system with a mailboxing arrangement having a plurality of mailbox bins and, more particularly, to a control system which facilitates assignment/reassignment of one or more mailbox bins of the plurality of mailbox bins.

The problem of keeping shared (networked) printer job outputs from becoming mixed up, or accidentally removed by others, especially where commonly stacked, even if the jobs are initially offset, is serious enough that some users have for several years placed manual mailboxes, like Post Office boxes, adjacent the printer, with the boxes labeled with different user names, for manual job sorting. Likewise, for shared facsimile machines.

The following additional partial broad definitions may be helpful to the discussions herein: "Mailbox[ing]": temporarily (or semi-permanently) assigning a unique predetermined electronic address to designated ones of plural bins of a sorter-like output device and enabling a user's output to be directed into a selected bin so assigned. It may or may not include locked bins. Preferably, the user's mailbox output is plural, pre-collated, jobs with all sheets going to a single bin, not requiring sorting. "Sorting": conventionally, this refers to sending one copy sheet of each original page into one bin of a sorter, the next copy sheet into the next bin, etc., repeated for the number of copies, until each of the plural bins required has one copy, then stacking one copy sheet of the next original in each said bin, etc. to compile one collate set in each bin. Thus, job or addressee "mailboxing" is not "sorting" in the common or usual sense of a collating plural identical copy sheets by sequentially placing each sheet in a different bin, and repeating those steps. However, similar "sorter" hardware may be employed in part if it can provide rapid random bin access and other desired features. "Stacking": providing the ability to arrange sets of sheets (which may be stapled or otherwise finished sets of sheets), into a well controlled, generally vertical, common stack, although partial "offsetting" of separate job sets may be desirable.

The term "mailboxing" as used herein refers to handling or sorting physical, i.e., "hard copy" printed sheets. It does not refer to electronic documents or images, which are much easier to manipulate.

To express it in another way, a "mailbox" in the example herein takes multiple print jobs from a printer (from user terminals, fax, networked purge images, scanned document jobs, or the like or combinations thereof) and separates jobs by users and stacks these hardcopy outputted print jobs into individual bins for individual users, by users. [As an additional software option, users may also send print jobs to other users' mailbox bins if desired.] Mailbox bins can, in general, be either user assignable, or automatically assigned by the printer, print server, or mailbox unit. Optionally, jobs can be individually stapled if a stapler unit is provided. Optional security doors can be added to any or all bins if desired. An overflow bin or general, shared, stacking tray may also desirably be provided, not assigned to any one user.

"Mailboxing" may more specifically, as in the example herein, refer to temporarily or permanently assigning a unique and predetermined electronic address to respective ones of plural bins of sorter-like equipment for a copier, printer or facsimile machine output, and enabling a particular user's output of one or more jobs to be directed into one or more selected bins so assigned. It may or may not include means for locking the bins and unlocking access thereto, as indicated above and as in the example herein. It may or may not additionally include a bin assignment scheme wherein each bin has an associated LCD or other type of display with the appropriate user name or label displayed, and/or a common or central display, as in the example herein, and/or wherein jobs are placed in more than one available bin if needed, i.e., if the sheet stacking capacity of one assigned bin is exceeded. As noted, a mailbox for a laser or other electronic page input printer may desirably print and feed plural precollated sets of sheets into a selected bin, rather than functioning as a normal collator or sorter, [although it may do so additionally or alternatively] since an electronic page printer can normally easily electronically reorder and recirculate the "original" pages being copied to "copy" and output them in precollated or serial page job set order, rather than making plural directly sequential copies of each page requiring post-collation and separate bins for each copy set in a sorter or collator.

A very desirable mailbox system feature is a "variable bin assignment" system in which many users can share one mailbox unit with only a limited number of bins by variable (dynamic) bin assignments and their electronic logging or tracking, with the bin assignment(s) for a particular user or group of users, depending on bin availability (the bins empty at any given time) rather then a fixed, permanent assignment of certain bins to certain users or customers. This greatly increases the effective capacity or the number of potential shared users.

Another very desirable and related "mailbox" feature is a "virtual bin" concept, in which the software in a programmed computer or controller controlling the mailbox sheet distributor puts the first job output of user A into an assigned bin X which is determined to be available. Then, if a subsequent job for user A will also fit into bin X, it is also put into bin X. If not, then the subsequent job for user A is automatically put into an assigned "overflow" bin Y, etc. I.e., for each user, the number of assigned bins is automatically increased to meet the users need. Preferably, adjacent bins are used for the job overflow. Art noted re bin overflow features in general includes Xerox Corporation U.S. Pat. No. 3,871,643 issued Mar. 18, 1975, to W. Kukucka and T. Acquaviva; IBM U.S. Pat. No. 4,522,486 to Clark et al. (using the term "virtual bin"); and U.S. Pat. No. 4,134,581 to Johnson, et al.

Another desirable feature is a bin assignment display system wherein the mailbox unit has a central (or bin-associated) LCD or other such bin-identifying operator display, and wherein user's jobs are placed in one, or (if needed) multiple, available bins, with all the appropriate bin(s) identified and displayed for the user name or other identifier, which may also be displayed. [See, e.g., U.S. Pat. Nos. 4,501,419 and 4,437,660, further discussed herein, and D/91519 and D/92247 noted immediately above.]

The present system is desirably usable for electronic mail hardcopy prints and/or other networked or shared user document prints in general. E.g., in a shared user, networked, printer environment, such as in a modern office environment, the printer can electronically recognize the sender or user terminal sending the printing job from network or document electronic information already available in said job. (Such shared printers may also have alternate scanner or floppy disk document inputs.)

It is additionally noted that combined facsimile and/or digital scanning, copying and printing (and even conventional light lens or digital copying) can be provided in one single unit, encompassed by the term "printer" as used herein. Note, e.g., Xerox Corporation U.S. Pat. No. 4,947,345 filed Jul. 25, 1989 and issued Aug. 7, 1990 to Paradise, et al.; U.S. Pat. No. 3,597,071, filed Aug. 30, 1968 and issued Jul. 27, 1971 to Jones; Fuji Xerox Co. Ltd. U.S. Pat. No. 5,038,218, issued Aug. 6, 1991 to Matsumoto; Sharp U.S. Pat. No. 5,012,892, issued Jun. 4, 1991 to Kita, et al.; and IBM Corp. U.S. Pat. No. 4,623,244, issued Nov. 18, 1986 to D. R. Andrews, et al., originally filed Oct. 4, 1976 (see, e.g., Col. 55). Such plural mode or combination printers are commercially available, e.g., the Xerox Corporation "DocuTech", the Fuji Xerox Co. Ltd. "Able" TM machine series (Able TM 3311, etc.) [Xerox 3010], the Canon "Navigator", and the Okidata "Doc.lt" multifunctional ["combo"] product announced Oct. 28, 1992. The latter allegedly provides simultaneous fax, printer, scanner, and copier capabilities, and includes a controller and image processing board that plugs into a user's PC. Faxes are received on the PC's hard disk. Another such multimode unit is the Xerox Corp. "7033" recently announced as a LAN fax server, scanner, copier, LAN print server, and/or digital printer-all in one network-ready unit. This multifunctional and "turnkey" solution integrates various components within a "NetWare TM" environment. A server board can be installed in the "7033" machine to allow a direct connection to the network (via Ethernet or token ring), and the machine can be attached directly to the network (like a network-ready printer), without having to dedicate a PC. The fax software provides shared users access to all of the "7033" terminal's features from their workstations. The fax terminal's software package is named "XPCONSOL" and is a menu-driven software which looks and feels like "PCONSOLE" and likewise, may be used to set up the "7033" as a network print server. The "7033" can handle both addressed and unaddressed incoming faxes. Network workstations can fax from the command line, an application, windows, or the copier-scanner itself. Other new multifunctional units include Xerox' DocuCenters 20 and 35 as well as the Ricoh DS95330, and Cannon GP55 series.

Of further "mailbox" interest, in Seiko Epson Corporation U.S. Pat. No. 5,141,222 issued Aug. 25, 1992 by Shigeru Sawada, et al., (and its equivalent EPO Application No. 0 399 565 "Printer" published Nov. 28, 1990), a modular unit sorter is generally indicated in Col. 1 to be for sharing a printer with a plurality of users, sorting and compiling copies by user. It claims an output sorter having fixed trays and a pivotable sorter guide member for directing copy sheets to a sorter tray. Each tray may also have a gate mechanism for retaining sheets in the tray. It is suggested in Col. 6 that a mailbox can be assigned or dedicated to each user, and used as a "mailbox" by entering an ID code and printing data. This reference is also of interest re detecting the fullness of a sorter bin and for delivering copy sheets to the next available sorter bin. I.e., also disclosed in said U.S. Pat. No. 5,141,222 reference Col. 8 are means for detecting the fullness [reaching of sheet stacking capacity] of a tray and incrementing this sorter tray copy sheet guide to another (empty) sorter tray. As noted, another example of that is disclosed in that above-cited Canon U.S. Pat. No. 4,501,419, issued Feb. 26, 1985 to Y. Takahashi, et al. (also cited herein re its bin entry gating and its bin display features).

Printer products noted with integral open sorter bins [the bin selection system is not known] include the Canon NP-9030 sold for several years with a sorter option; the Kyocera F-2010 and F-3010 laser printers with their 5 bin sorter option (since 1988?); and Oce van der Grinten Corporation's recently commercially displayed "6750" and "6800" printers configurable with either 20 or 40 bin optional programmable sorter/mailboxes. Toshiba and its OEM Genicon recently announced a 10 bin "mailbox sorter" for their network printers, supported by a Windows driver. The Toshiba user selects a bin number from the driver menu (not the network). Thus, users all have to agree among themselves who gets what bins. The Genicon system allows the network administrator to assign bins.

Variable/dynamic assignment of mailbox bins is discussed in U.S. patent application Ser. No. 08/585,079, entitled "Sheet Stacking Bin Fullness Control System" and filed originally as a provisional application (Ser. No. 004,825) on Oct. 5, 1995 by Mandel et al. As indicated by the '079 Application:

As variously taught by above-cited patents, the disclosed mailboxing system can provide for stacking the sheets sequentially outputted from the printer 14 in separate job sets into one or more temporarily and/or variably reassignable mailboxes 11 of the mailboxing or job sorting accessory unit. This assignment can be by a mailbox controller 100 controlling a sheet distribution system such as 16, automatically and/or with keypad 102 and/or display 104 entry by a user or system administrator, and/or with initial setups in NVM by the installer, and/or or remote terminal electronic setups or changes such as from remote workstations 15. The setups and/or defaults can be for the entire mailbox or for individual bins. As will be further discussed, the system setup my may include assigning more than one user to one or more bins, e.g. a workgroup or team and/or a secretary may share bins. Some or all of the assigned mailboxing units or bins thereof may have "privacy doors" which are normally locked to restrict access to at least some of the mailbox bins, with electrical unlocking of selected bins privacy doors in response to entry of a access code for that user on the keypad 102 or elsewhere, and/or other features, as also described in the above cited mailbox patents.

As taught in those cited patents, what is normally desired for the output for each utilized mailbox bin is plural, precompiled, preferably offset (and/or pre-stapled) job sets stacked in selected bins respectively assigned to respective users of the printer 14. What is also desirable is an automatic overflow assignment system of additional temporarily designated bin(s), as needed, to provide effectively unlimited or "virtual bin" plural job stacking. As will be further described, this bin reassignment and/or job overflow system is preferably integral with and controlled by the disclosed bin full and/or bin-almost-full sensing systems herein. As is also described in said cited mailbox patents, a variable display such as 104 may be provided to indicate the assigned bin and any overflow bins into which that particular users print jobs have been placed last and not yet removed. This instructional display can also be on the respective user terminal 15 display (FIG. 6). That is, the mailbox system or system server can automatically generate network messages sent back to the user's (job senders) terminal 15, and/or to the systems administrator terminal 15, if desired, so that the terminal 15 screen displays a status message like "your print job is completed—remove it from bins #3 and 4"; or "the printer is out of paper"; or "all bins are full—clear bins to continue printing", and the like.

As further described in said U.S. Pat. No. 5,328,169 and related patents, one aspect of such a "dynamic" (variable) user bin assignment system is that each "mailbox" (separate bin to be utilized therefor) can be frequently checked (updated) for reassignment of that bin to a new user. That is, reassignment to other users of bins which have since become available by the removal of all the printer output sheets therefrom by the previous user of those bins. The mailbox controller 100 can periodically interrogate the bin-empty sensors 40 to see which bins 11 are then empty. This interrogation is preferably done each time the printer and/or print server is sent (and/or is preparing to print) a print job. Unlike a sorter or collator, it is not necessary to free up (empty) a whole series of bins. Any one free bin can be fed job sheets, even if that one empty bin is between other, unemptied, bins. The bins assigned are then stored in memory, and can be identified whenever jobs are to be retrieved. However, as discussed elsewhere herein, there are situations is which having only a bin-empty sensor can be inadequate.

Additionally, U.S. Pat. No. 5,358,238 to Mandel et al. discloses a dynamic "mailboxing" unit and system for separating by users the sheet ouptuts of various users of a shared users printer (including facsimile receivers, copiers or combination units). The unit and system provide for stacking the sheets sequentially outputted from the printer in separate job sets into one or more temporarily and variably assigned "mailboxes" of a "mailboxing" job sorting accessory unit having a number of variably assignable "mailbox" bins.

There are assignment situations which are not believed to be addressed by the prior art:

In one example, a user may wish to have an output of their job delivered to a mailbox bin even when such output would not normally be delivered to a mailbox bin. In particular, the developer of a copy job, in which a hardcopy is scanned for delivery of prints to an output tray, may desire an approach in which the job output is delivered to a mailbox bin in view of a current state of a host copier upon which the copy job is being developed. For multifunctional copiers with secured boxes intended for use in receiving prints from print jobs, rather than copy jobs, however, this is not believed to be an approach that is normally made available. It would be desirable to provide copy job developers with the opportunity, under certain circumstances, to deliver his/her copy job to a mailbox which would normally be configured for a print job.

In another related example, the user of a mailboxing system may desire to deliver one type of job to a first set of one or more mailbox bins and another type of job to a second set of one or more mailbox bins. In particular, a user may develop one job that is preferably delivered to a nonsecured bin and another job that is preferably delivered to a secured bin. It would be desirable to provide the user with the ability to dynamically control the one or more mailbox bins to which the job is to be delivered.

In yet another related example, the number of mailbox bins available in a given system may be exceeded by the number of users who wish to access such bins. That is, during a given time interval, X users may seek to use Y bins where Y is significantly greater than X. Among the X users, however, there may be some users that should be provided with immediate preferential treatment. Moreover, certain users, due to a certain affiliation, e.g. being affiliated with the same workgroup, may be in a position to share a given secured mailbox bin rather than demand exclusive use of a single secured mailbox bin. In other instances, where a user is denied access to either a private or group shared bin, s/he may be in a position to have a corresponding job routed, at least on a one time basis, to a bin made available to the public as a whole. While it is known to configure a plurality of bins into a private group and a public group, such configuration does not accommodate for needs of users who are willing to share a bin with others, but still desire a level of privacy that is not afforded by a public bin. It would be desirable to provide a mailbox bin subsystem in which levels of use other than simply private and public are afforded.

In application of such bin configuration, it may be desirable to change bin access rights automatically. For example, it might be desirable to change access rights when one or more users fails to use a bin over a selected period of time. It is known, as a result of the disclosure of U.S. Pat. No. 5,435,544 to Mandel, that a group of mailbox bins can be monitored to determine when a job has been left in one of the bins for an unacceptable period of time. In one instance, an operator (e.g. system administrator) can be instructed to remove jobs from bins that have been deposited in the bins more than 24 hours earlier.

The presently disclosed system may be readily operated and controlled in a conventional manner with conventional control systems. It is well known in general and preferable to program and execute such control functions and logic with conventional software instructions for conventional microprocessors. This is taught by various patents such as U.S. Pat. No. 4,475,156 and art cited therein, and various commercial facsimile machines, copiers and sorters. Such software may, of course, vary considerably depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems.

Other mailboxing patents which might be useful to an understanding of the present disclosure include U.S. Pat. No. 5,551,686 to Sanchez et al. (Issued: Sep. 3, 1996), U.S. Pat. No. 5,547,178 to Costello (Issued: Aug. 20, 1996) and U.S. Pat. No. 5,342,034 to Mandel et al. (Issued: Aug. 30, 1994). All references cited in this specification, and their references, are incorporated by reference herein where appropriate for appropriate teachings of additional or alternative details, features, and/or technical background.

SUMMARY OF THE INVENTION

In accordance with one aspect of the present invention, there is provided a control system for a sheet handling system having a mailboxing system with a mailbox bin subsystem. The mailbox bin subsystem includes a print receiving bin set with a plurality of print receiving bins, the plurality of print receiving bins being corresponded with a set of bin users. The control system includes: a user interface with which one or more print receiving bins of the plurality of print receiving bins are assigned to one of the bin set users; and a controller communicating with said mailbox bin subsystem. In practice the controller: (1) determines, for the one bin set user, a frequency of use value varying as a function of a degree to which the one bin set user uses the one or more print receiving bins to which the one bin set user is assigned, and (2) reassigns one of the one or more print receiving bins to which the one bin set user is assigned when the frequency of use value drops below a preselected threshold and a selected condition is met.

In accordance with another aspect of the present invention, there is provided a method for a sheet handling system having a mailboxing system in which a controller communicates with a mailbox bin subsystem including a print receiving bin set with a plurality of print receiving bins. Preferably, a user has a current assignment in which the user is assigned zero or more of the plurality of print receiving bins, and a past use history is generated when the user delivers one or more prints to one or more of the plurality of bins within a selected time interval. The method, which permits selective changes to be made in the user's current assignment on the basis of a request communicated to the controller, includes: (a) receiving the request at and reading it with the controller; (b) in response to said reading of (a), obtaining a past use history for the user when a past use history already exists for the user; (c) when said past use history exists, examining the past use history to determine whether the past use history includes a pattern, based on frequency of use, suggesting that a change in the user's current assignment of print receiving bins is warranted; and (d) when said pattern suggests that a change in the user's current assignment of print receiving bins is warranted and a selected parameter has been met, changing the user's current assignment.

BRIEF DESCRIPTION OF THE DRAWINGS

FIG. 10 is an elevational view of a display for a user interface in which three windows associated with one or more databases are shown;

DESCRIPTION OF PREFERRED EMBODIMENT(S)

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
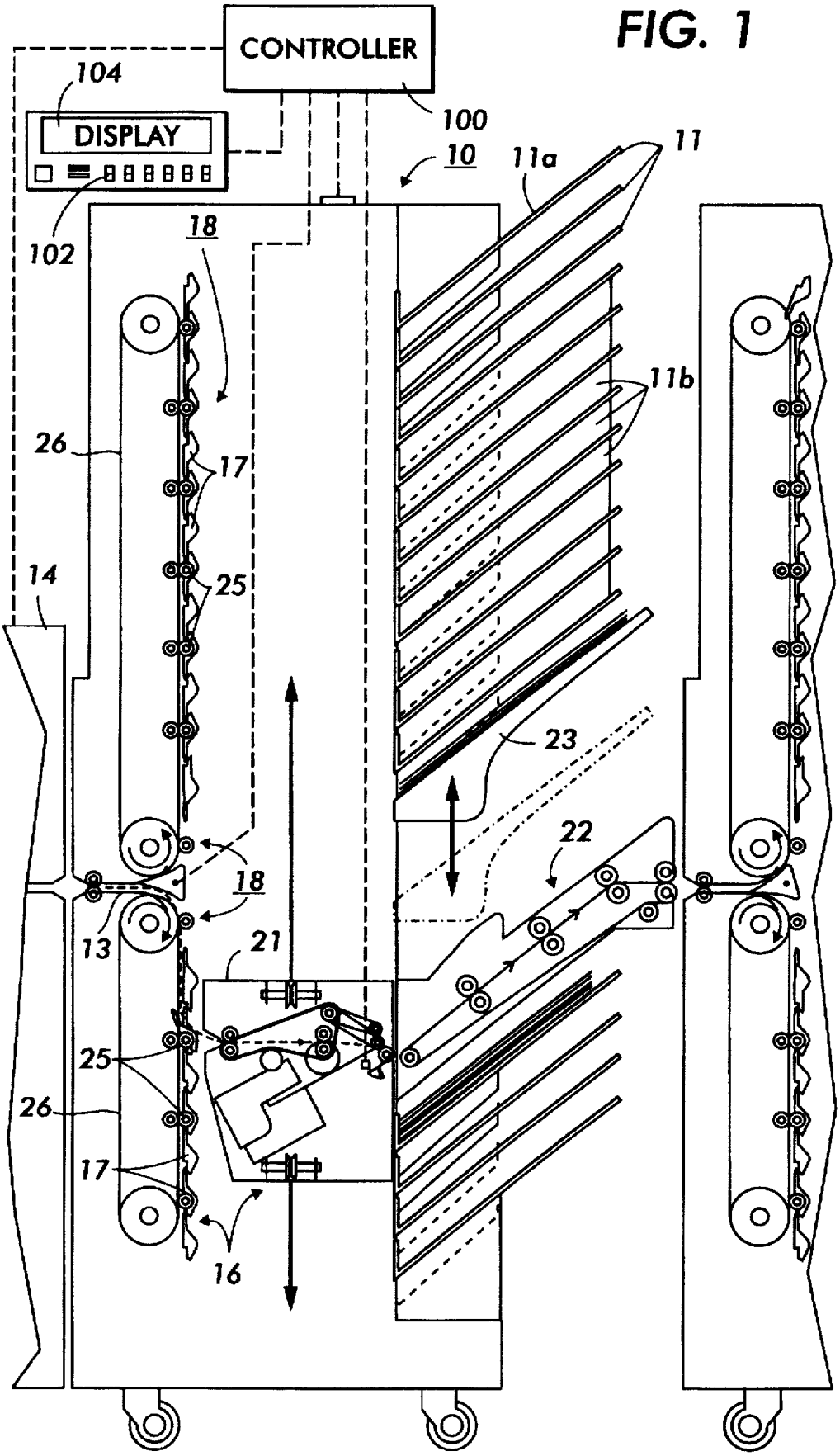
FIG. 1 is an elevational view of one example of a multibin array "mailboxing system unit connecting with the sheet output of a printer (partially shown schematically) with an example of a repositionable sheet transport and bin selection or distribution system.

Referring to FIG. 1, an exemplary embodiment of a mailbox unit is designated with the numeral 10. The mailbox bins, 11, 11*a*, 11*b*, etc., illustrated or described herein are also merely exemplary, and may vary considerably. The general reference number 11 is used throughout for any individual mailbox (bin). Bin 11 a here is an exemplary overflow bin, conventionally located here as the top bin. In one example, the Bin 11*a* could be employed as a high capacity bin. This top bin or tray 11*a* of the unit 10 may conventionally provide an open or "public" bin. A top bin is commonly used for undesignated or unknown user's jobs, job overflows, jam purges, etc., since it is not limited in stack height by any overlying tray. Bins 11*b* here schematically represents some examples of restricted access mailbox bins 11 which are lockable and unlockable, e.g. have latched privacy doors, as described further in the above cited patents thereon.

Figure 2:
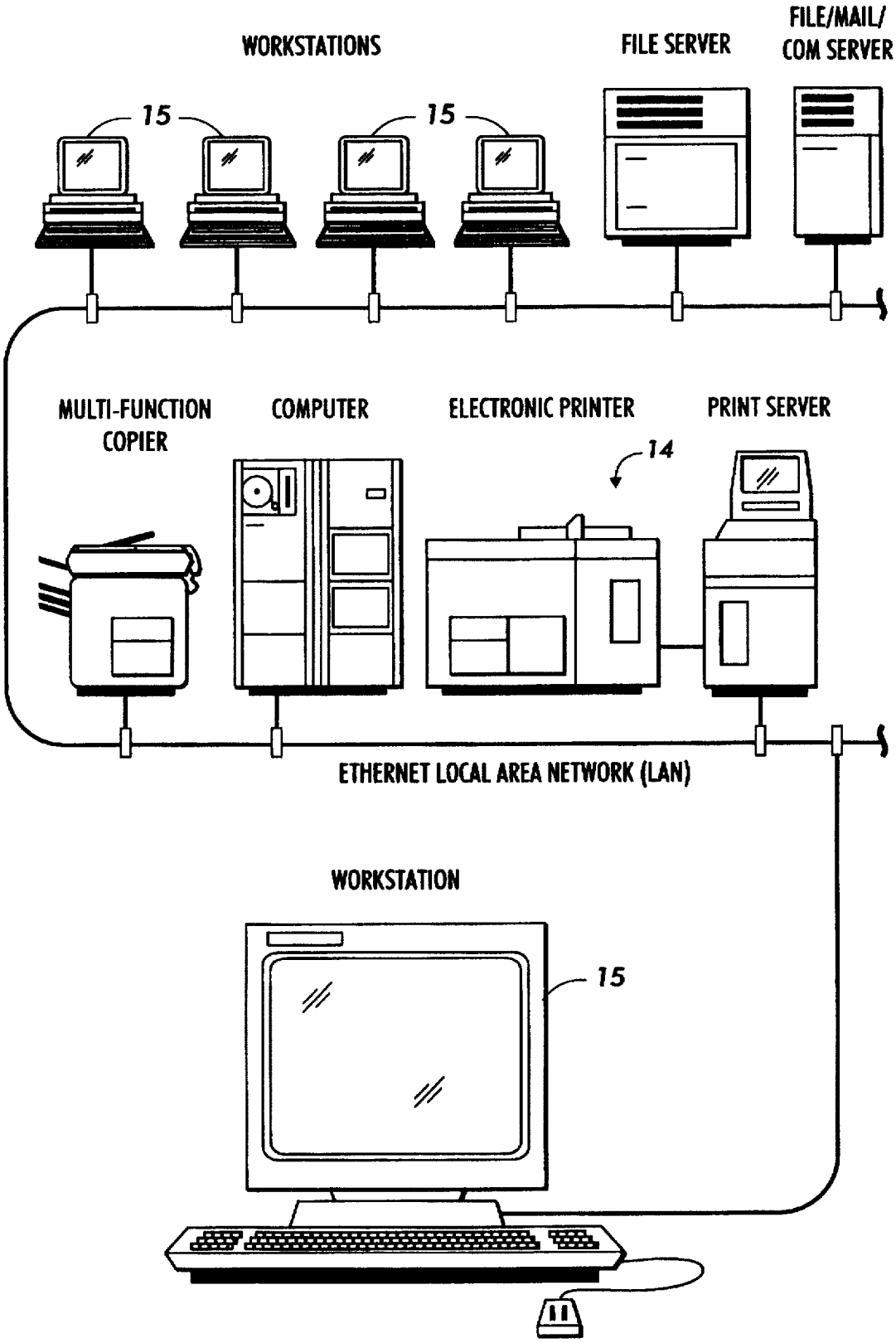
FIG. 2 PRIOR ART
FIG. 2, labeled "prior art", is a schematic overall view of one example of an electronically networked system of plural users (plural workstations) sharing an electronic printer and a multifunctional digital copier with a digital front end.

Various printers (of which printer 14 in FIGS. 1 and 2 is merely one schematic example) may be connected to these and other mailboxing systems, with little or no printer modifications, as part of various systems. In FIG. 2, merely by way of an example of systems applications, the exemplary shared user electronic printer 14 is shown connected into a conventional prior art inneroffice or interoffice system electronic network with various remote user terminals (workstations) 15, one of which is shown here in an enlarged view. Some other possible typical network system components are also illustrated and labeled. For example, a multifunctional printing system, including, printing copying and faxing functionality, is shown. A discussion of network printing is provided in U.S. Pat. No. 5,358,238 to Mandel et al.

Preferably, the mailbox unit has a sheet input or entrance such as 13 which adapts or adjusts to common or various printer output levels, or an interface unit or interconnect transport may be provided in a known manner to sequentially feed the printer output sheets from the printer 14 into the mailbox unit 10 sheet entrance 13. Alternatively, the mailbox unit can be integral with the printer unit, built into or attached above or to one end thereof, such as by conventionally integral cantilever mounting to or above the output end of the printer 14, like certain known sorters. The conventionally sequentially received hard copy of plural page documents from the pre-collation output electronic printer 14 or the like is thus fed into the mailbox unit 10, along with any added or interposed insert sheets, such as covers, tab sheets or color photographs, to make up desired print jobs. The path of these sheets in the mailbox unit is via a sheet distribution system 16 automatically controlled by a controller 100, or otherwise, for the particular bin 11 assignment or destination of the particular job sheets. As noted previously, and extensively discussed in above-cited patents, the mailbox unit 10 preferably directs all designated sheets of a users job to an available bin or bins 11 which are temporarily assigned to that particular printer user, based on bins availability, which may be an empty bin or a bin which is not yet full.

Preferably, each bin 11 has an individual "bin empty" sensor (not shown), such as that described in Xerox Corp. U.S. Pat. No. 5,328,169 issued Jul. 12, 1994, to Mandel, each of which bin empty sensor communicates with controller 100. This enables the sheet path control bin selection system of the mailbox unit 10 to know immediately when any bin has been fully cleared by anyone (a printer user, print job or facsimile addressee, recipient, system administrator, etc.). Thus, any empty bin can be refilled with further print jobs for the same designee(s), or immediately reassigned to a new user, job addressee or recipient. This is the case even where the same mailbox bin or bins may be allowed to shared by more than one user or addressee, since, notwithstanding directions or displays to the contrary, any user or addressee with access to that bin could remove all the print jobs in that bin, not just his or her own print jobs. However, if only his or her own print jobs are removed from that shared bin, and there are any print jobs for others left remaining in that bin, or reinserted back into that bin, the bin empty sensor cannot tell how much material was removed, or how much stacking space is thus now available, as even a single remaining sheet in the bin will block such a bin empty sensor.

A bin fullness sensor, such as those described herein, or others, could be modified to additionally sense empty, and thus fully available, bins, and eliminate any need for separate bin empty sensors. E.g., by providing for the end of the stack height sensor arm extending into the bin to partially drop though a hole or slot in the bin tray bottom to an arm position triggering another optical or other sensor for that bin empty arm position, as is well known in the set separator sensor art for recirculating document handler trays. However, since here a single stack height sensor is desired to be used and shared for all the bins in the array of bins, that would require this single sensor to be frequently moved up and down the array of bins to check for emptied bins. That would reduce productivity while that is being done.

Thus, here, bin empty sensing is combinable with, but distinct from, the presently disclosed system for checking for full or almost full bins, since the single stack height sensor disclosed here for that function in mailbox units is mounted on, and moves with, the mailbox carriage unit 21 which is part of the sheet distribution system 16 directing sheets into the particular bin 11 which is then being filled here. Thus, the stack height sensor system here is already automatically located adjacent to the particular bin 11 who's stack height needs to be sensed or measured during filling since it is the bin being filled at that time. However, unlike bin filling, as to bin emptying, any mailbox bin 11 may be manually emptied at any time, unless it is a locked bin **11*b*. Even if the controller 100 receives an unlocking signal or password, it will only know which bins 11*b*** have been unlocked then, and will not know whether or not those unlocked bins have actually been either partially or fully emptied, unless there is a bin empty detection or sensing signal from that bin.

Referring further to the illustrated exemplary mailbox unit 10 in FIG. 1, this is a universal stand-alone unit that is attached to, or simply moved next to, the output of almost any conventional printer. This particular illustrated mailbox unit 10 is basically that shown and described in the above cited and incorporated prior Xerox Corporation mailbox unit U.S. Pat. Nos. 5,382,012 issued Jan. 17, 1995, and 5,370,384 issued Dec. 6, 1994, and thus need not be re-described in detail here. This particular mailbox unit 10 has plural fixed bins 11, into which either single sheets, or collated and stapled or unstapled job sets of multiple sheets, are selectively fed by a sheet distribution system 16, here including a vertically repositionable (movable) bin selector carriage 21. As further described and disclosed in above cited prior patents, the movable carriage 21 comprises an integral sheet set collator and finisher unit which may be called a finishing carriage. The selected vertical position of the finishing carriage 21 here also serves to cam actuate the selected corresponding position sheet deflector gate 17 in the sheet vertical transport path 18 on the upstream side of the finishing carriage 21, so as to select the sheet path from the transport path 18 through the carriage 21 into the adjacent selected bin 11. The belts 26 of the vertical transport 18 are laterally spaced apart so that the fingers of the selected gate 17 may pivotally extend between the belts 26 when that gate 17 is actuated. The particular vertical transport 18 here has sets of both up and down flights of moving belts 26, each with mating belt rollers 25, to allow for the mailbox unit 10 sheet entrance 13 to be centralized by entering in between these up and down belt flights.

This internal sheet feeding and/or sheet distribution system in the mailbox unit can utilize various other alternative different known random access bin selector type sorter sheet transports, many of which are known in the art. Various well known feeding and gating arrangements whereby inputted sheets are fed to and gated into selected bins include, for example, a moving gate sheet deflector system without a compiler or finisher, such as is disclosed in Norfin Co. U.S. Pat. No. 3,414,254 to Snelling, et al.

The collator, stapler and stapling system on the finishing carriage 21 may be, for example, that further described in Xerox Corporation U.S. Pat. No. 5,398,918 issued Mar. 21, 1995, to C. Rizzolo, et al. It provides stapling in one or more locations selected by linear movement of a stapling head along a stapling line, which line position may be preset to a small fixed distance parallel to one edge of the compiled set. Thus, as finished sets are stacked into a bin 11 from the finishing carriage 21, any staples in the print job set are known to be somewhere along a known position line.

As is also shown here with this exemplary mailbox unit 10 in FIG. 1, additional mailbox units such as 10 can be extended or serially connected to provide additional sets of available bins 11, where desired, as is well known in sorting. That is, plural mailbox units 10 may be ganged in series like plural sorter units using sheet pass-through or bypass feeders such as 22 shown here. This is further described in said Xerox Corporation U.S. Pat. Nos. 5,382,012 and 5,370,384.

The relatively low capacity (e.g., less than 100 normal sheets) mailbox bins 11 normally used for separating by users their plural printing jobs, which may include copy or fax jobs, may also be supplemented by optional or overflow sheet delivery into a high sheet capacity stacking tray system, such as the FIG. 1 elevator stacking tray 23, which is desirably part of the same vertical array of bins, and desirably selected and fed sheets or sets of sheets by the same sheet distribution system 16. That can be an optional module mounted onto the same frame in place of one or more of the mailbox bins 11, as disclosed in above-cited patents, especially U.S. Pat. Nos. 5,382,012 or 5,370,384. The structure and operation of such an elevator stacking tray 23 is well known per se, and described in some of the above cited patents. An elevator motor system connecting with the elevator tray 23 maintains the top of the stack of accumulating sheets thereon at a suitable height below the sheet input to that stack, which here is the exit or eject rollers nip of the finishing carriage 21. This typically requires a separate sensor and sensing arm to sense the stack height in the elevator tray 23 to control the actuation of the tray elevator motor.

It will be appreciated that the stacking height or sheet capacity of the bins in any given mailbox unit may vary. A sorter or mailbox may have repositionable trays for changing their spacing. Furthermore, certain bins such as lockable mailbox bins or bins with privacy doors may have a somewhat smaller usable available spacing between bins and/or stacking height and thus bin capacity, due to thicker tray materials, the bin door locking mechanisms, or the set removal system from the tray, etc. Privacy door restricted access bins are described in detail in the above cited patents, and schematically shown at 11 b in FIG. 1. Bins which are to be shared by more than one user might be higher capacity bins than those bins which will not be shared. As discussed, the top bin typically is an overflow bin with much higher maximum stacking level or capacity, since there is no overlying or superposed tray. Additional overflow or large jobs stacking can be provided by a special stacking tray, as exemplified by the high capacity elevator stacking tray 23 shown in FIG. 1 and further described herein.

As variously taught by above-cited patents, the disclosed mailboxing system can provide for stacking the sheets sequentially outputted from the printer 14 in separate job sets into one or more temporarily and/or variably reassignable mailboxes 11 of the mailboxing or job sorting accessory unit. This assignment can be by a mailbox controller 100 controlling a sheet distribution system such as 16, automatically and/or with keypad 102 and/or display 104 entry by a user or system administrator, and/or with initial setups in NVM by the installer, and/or or remote terminal electronic setups or changes such as from remote workstations 15. The setups and/or defaults can be for the entire mailbox or for individual bins. As will be further discussed, the system setup my may include assigning more than one user to one or more bins, e.g. a workgroup or team and/or a secretary may share bins. Some or all of the assigned mailboxing units or bins thereof may have "privacy doors" which are normally locked to restrict access to at least some of the mailbox bins, with electrical unlocking of selected bins privacy doors in response to entry of a access code for that user on the keypad 102 or elsewhere, and/or other features, as also described in the above cited mailbox patents.

As taught in those cited patents, what is normally desired for the output for each utilized mailbox bin is plural, pre-compiled, preferably offset (and/or pre-stapled) job sets stacked in selected bins respectively assigned to respective users of the printer 14. What is also desirable is an automatic overflow assignment system of additional temporarily designated bin(s), as needed, to provide effectively unlimited or "virtual bin" plural job stacking. As will be further described, this bin reassignment and/or job overflow system is preferably integral with and controlled by the disclosed bin full and/or bin-almost-full sensing systems herein. As is also described in said cited mailbox patents, a variable displaymay be provided to indicate the assigned bin and any overflow bins into which that particular users print jobs have been placed last and not yet removed. This instructional display can also be on the respective user terminal 15 display (FIG. 2). That is, the mailbox system or system server can automatically generate network messages sent back to the user's (job senders) terminal 15, and/or to the systems administrator terminal 15, if desired, so that the terminal 15 screen displays a status message like "your print job is completed—remove it from bins #3 and 4"; or "the printer is out of paper"; or "all bins are full—clear bins to continue printing", and the like.

As further described in said U.S. Pat. No. 5,328,169 and related patents, one aspect of such a "dynamic" (variable) user bin assignment system is that each "mailbox" (separate bin to be utilized therefor) can be frequently checked (updated) for reassignment of that bin to a new user. That is, reassignment to other users of bins which have since become available by the removal of all the printer output sheets therefrom by the previous user of those bins. The mailbox controller 100 can periodically interrogate the bin-empty sensors to see which bins 11 are then empty. This interrogation is preferably done each time the printer and/or print server is sent (and/or is preparing to print) a print job. Unlike a sorter or collator, it is not necessary to free up (empty) a whole series of bins. Any one free bin can be fed job sheets, even if that one empty bin is between other, unemptied, bins. The bins assigned are then stored in memory, and can be identified whenever jobs are to be retrieved. However, as discussed elsewhere herein, there are situations is which having only a bin-empty sensor can be inadequate.

Figure 3:
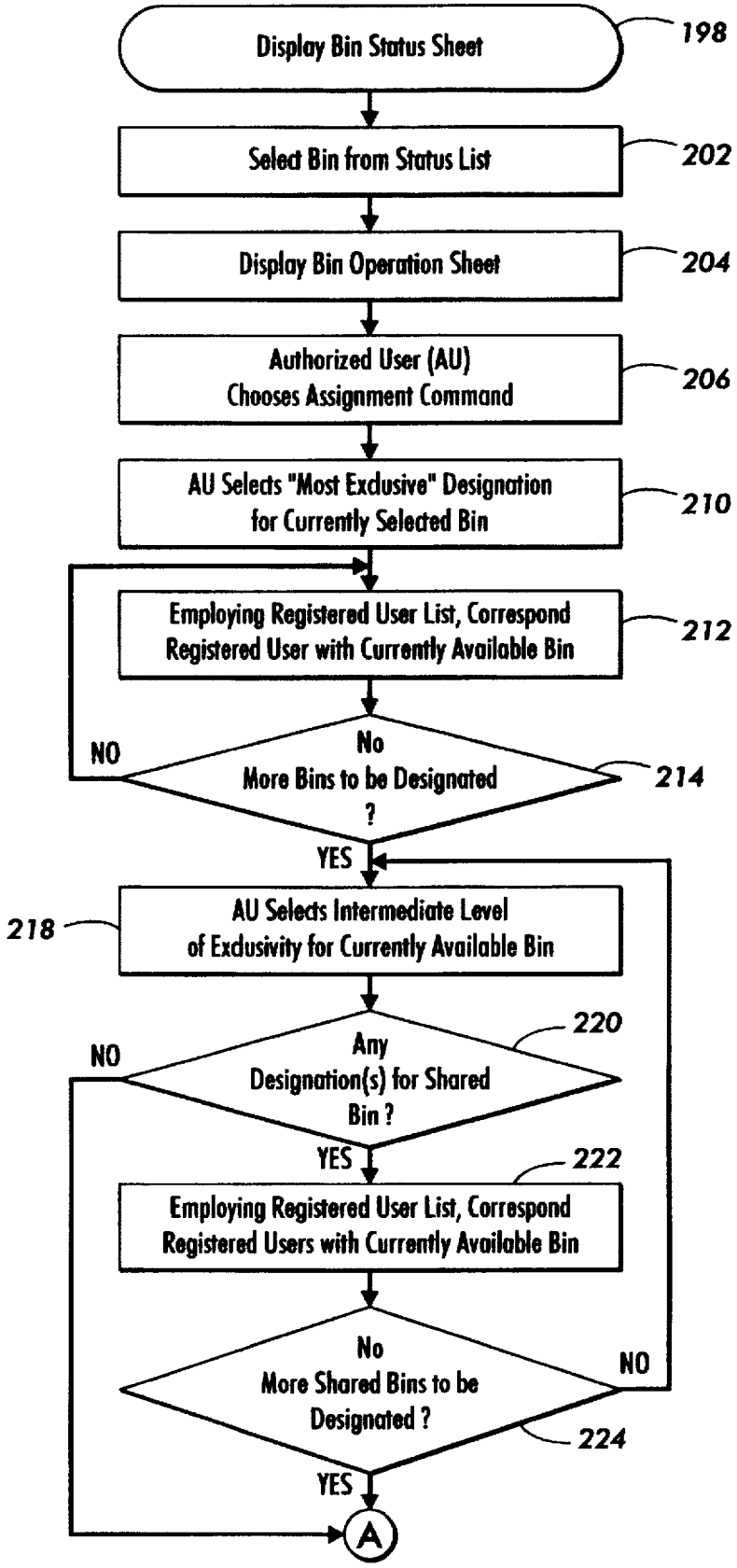
FIGS. 3 and 4 comprise a flow diagram illustrating a technique for assigning bin access designators to selected groups of mailbox bins.
Figures 4, 5:
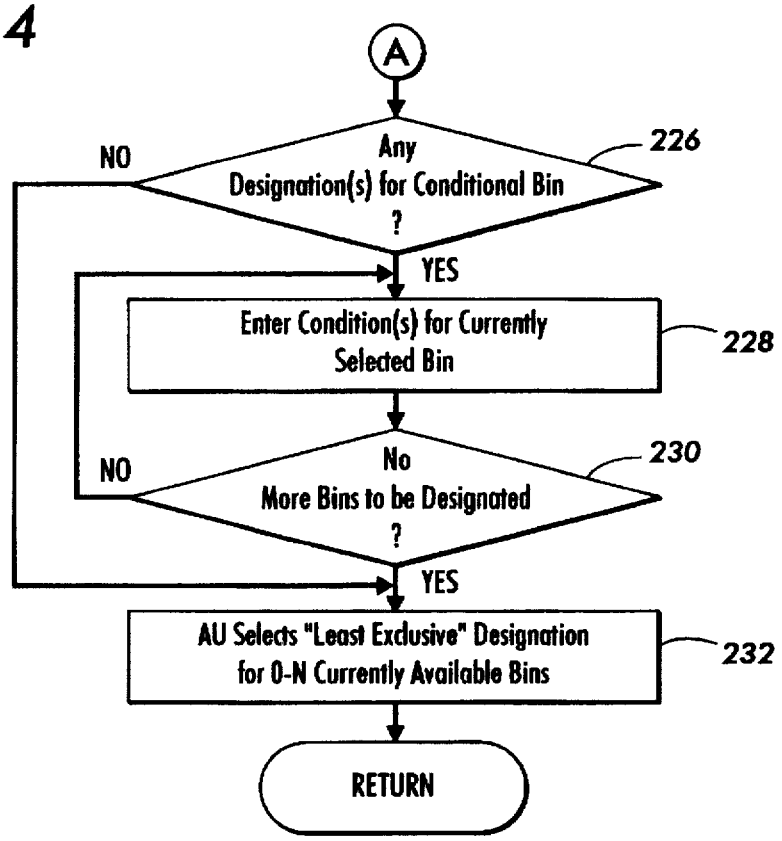
FIG. 5 is a schematic elevational view of a dialog used to facilitate the bin assignment technique portrayed in FIGS. 3 and 4.

Referring to FIGS. 3–6, a system for assigning mailbox bins by an authorized user or system administrator, and controlling the delivery of sheets to such bins, is shown. Referring specifically to FIGS. 3 and 5, an approach for designating bin groups, according to use type, is discussed in detail. For initial setup, a bin assignment dialog 196, which indicates those bins available for configuration/reconfiguration, is displayed at step 198. In the illustrated approach of FIG. 3, one of the bins is selected from a list 200 (FIG. 5)—the list being representative of a window into a database (step 202 of FIG. 3)—and a sheet 203, designating what operations can be performed on the bins in the database window, is displayed by way of step 204. As shown in FIG. 5, the list of operations includes a bin assignment command, which command is selected, at step 206, by an authorized user. In the illustrated technique of FIGS. 3 and 4, the dialog 196 is opened once and maintained in the open state throughout the assignment process; however, it is contemplated that the dialog could be opened and closed throughout the process depending on design choice.

Referring specifically to the list 200 of FIG. 5, some of the bins are corresponded with a bin access designator. For example, bin 1 is corresponded with a "Private" designator, bin 3 with a "Semi-priv[ate]" designator, bin 5 with a conditional designator (referred to, in one example, as "Priv./Semi-Priv.") and bin 2 with a "Public" designator—the significance of these designators, as they appear in the priority of (1) private, (2) semi-private, (3) conditional and (4) public will appear from the following discussion of FIGS. 3 and 4.

It should be understood that a bin access designator dictates the exclusivity which is to be accorded one or more mailbox or print receiving bins. As discussed in the above-mentioned mailboxing patents, a bin may have a particularly high level of exclusivity in that it is intended to be employed for single, private use or a particularly low level of exclusivity in that it is intended to be accessed by any member of the public. Semi-private boxes are typically used by a group that is related through a common purpose—for example each member of the group may be part of a common "workgroup". A Semi-private box may also be one in which the exclusivity of the box depends on the occurrence of an event or condition. While the present description addresses four levels of exclusivity, the precepts underlying the preferred embodiment would not be undermined by use of more or less than four levels of exclusivity.

Additionally, it should be appreciated that a private or semi-private box can be locked or open. Two locking systems, namely a mechanical locking system and an electronic locking system are contemplated by the preferred embodiment—a mechanical locking system is disclosed by the mailboxing patents above. The electronic locking system is directed toward an approach in which a job is held in memory until a password is provided by a selected user at a suitable interface. A hold and release system of this type is disclosed in U.S. Pat. No. 4,843,571, the disclosure of which is incorporated herein by reference.

At step 210, the AU selects one of the lines in the list 200 (FIG. 5) and provides the corresponding bin with a most exclusive or "Private" designation. In configuring the selected bin, the AU preferably accesses a list of registered users (not shown) including candidates for assignment to bins of the mailbox bin subsystem. A name from the list is then corresponded with the selected bin.

Storage of a user list and appropriate employment of such list is well known in the art. For example in one version of Microsoft Mail, a user addresses mail items through use of a list referred to as an "address book". Additionally, as mentioned above, the list 200 is preferably part of a data base which can be subjected readily to search operations. Thus, if "Paul" is assigned to bin 1, a suitable search request, as discussed in further detail below, permits delivery to Paul's bin by use of the database. As each bin selected with step 210 is configured, via step 212, it is determined, via step 214, whether any more bins are to be designated with the Private bin access designator.

If no further bin access designators are to be assigned in the most exclusive or Private category, then the process permits the AU, via step 218, to select a bin for designation at an intermediate or "Semi-private" level of exclusivity. Provided that the Semi-private bin is intended for use as a shared bin (see step 220), the Semi-private or "Shared" bin is configured with a group of user names by reference to a suitable registered user list. In an approach contemplated by the preferred embodiment, a name can be added or deleted from the group of user names by suitable use of the sheet 203 (FIG. 5) in conjunction with the list 200. In one instance, the user name group of bin 4 could be modified by selecting "Dave" and deleting the same with the "Delete" command of sheet 203. Referring to step 224, assuming that no more workgroup type shared bins are to be configured, the process may move through decision 226 to step 228 where one or more conditions can be added for a currently selected bin.

One of various conditions may be set by the AU with respect to the use of one or more bins. For example, a bin may be designated as a workgroup shared bin until a predesignated user indicates with suitable input (e.g. one or more signals) to the controller 100 (FIG. 1), that the exclusivity level of the bin is to be raised from a Semi-private level to the Private level. Referring to the example of FIG. 5, bin 5 is configured so that the bin is treated as a private bin for each of John's jobs, but as semi-private when an authorized workgroup participant other than John sends his/her job output to the bin 5. Other conditions are contemplated for use with conditioned boxes.

Once shared and/or conditioned bins have been designated, by use of decision step 230, the AU is free to designate any other available bin (step 232) as a "Least Exclusive" use type bin. In one example, a Least Exclusive designation for a mailbox bin would designate that the bin is made available to the public at large on a first-come first-serve basis.

Figure 6:
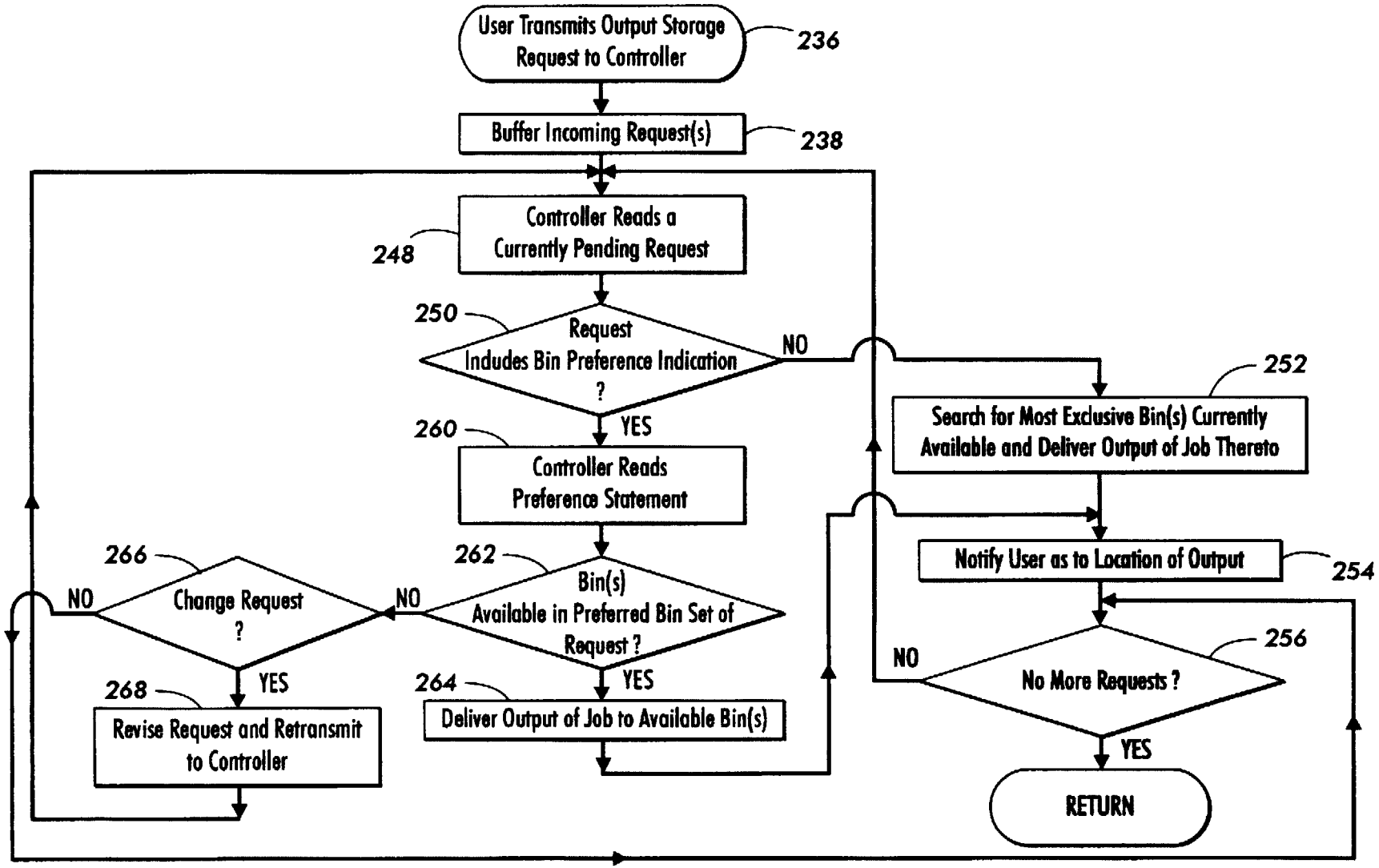
FIG. 6 is a flow diagram illustrating an interactive technique in which an output storage request is used to facilitate the delivery of job output to one or more preassigned mailbox bins.

Referring to FIG. 6, a manner of using the class designating approach of FIGS. 3 and 4 is discussed. Pursuant to developing control instructions for a document job with a suitable job ticket (of the type shown in U.S. Pat. No. 5,206,735 to Gauronski et al., the disclosure of which is incorporated herein by reference), a user desirably designates, by way of an output storage request (step 236) (also see FIG. 7) that the output of the job, i.e. prints, is to be delivered to one or more mailbox bins corresponding with one or more bin access designators. As will appear, the developer of a document job can designate, with a varying degree of specificity, which type(s) of bin(s) is to receive the document job output. In the preferred embodiment, the user stores the job ticket, including the output storage request, for future use in processing the job. It will be appreciated that the output storage request can be developed and buffered (step 238) at any time prior to delivery of the document job output to the mailbox bin subsystem of FIG. 1.

Figure 7:
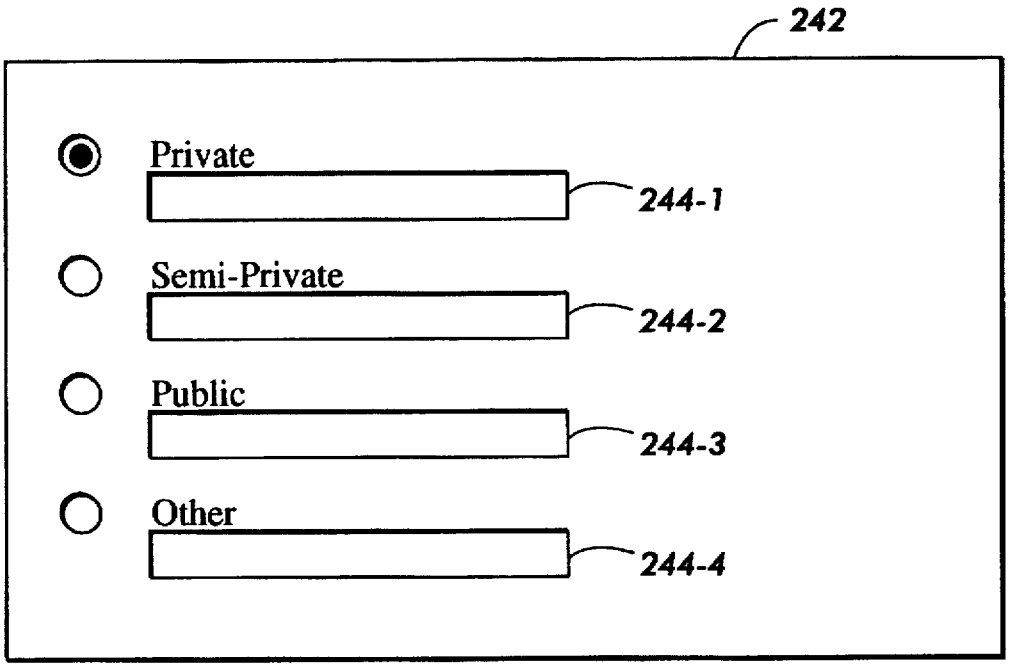
FIGS. 7–9 each include a schematic, elevational view of a dialog used to implement, in one example, the output storage request of FIG. 6.

Referring to FIG. 7, an output storage request ticket is designated by the numeral 242. Preferably, the ticket 242 permits a user to choose up to three levels of use type. The present approach contemplates a system in which the user either designates (1) none of the levels, (2) just one of the levels, (3) two of the levels, or (4) three of the levels. In the dialog of FIG. 7, the choice of a conditional bin is incorporated in the Semi-private choice, but in another embodiment, the choice of a conditional bin could be broken out into a separate choice. As explained in further detail below, each level includes an input/display area 244-X by which the user can specify bin preferences or indicate specific bins for receiving output copy(ies). In order to provide the user with an optimum level of flexibility, a choice referred to as "Other", the significance of which is discussed in further detail below, is provided. Additionally, the input/display area can be used to prompt the system to provide a user with information regarding those bins that are currently assigned to him/her. In particular, a user may query for "Paul's bins" and a search of a corresponding database, such as the database corresponding with the list 200 of FIG. 5) permits for a listing of Paul's bins, one of which, as shown in FIG. 5, includes Bin 1.

Pursuant to processing a document job, the controller 100 (FIG. 1) reads one of the requests in the buffer (step 248) and determines, at step 250, whether the request expresses a preference as to where an output of the job should be delivered. In the event that no preference is stated, then a search is performed with the controller (step 252) to determine if a Private bin is open. In the example, Bin 5 is open so the job output (i.e. prints) are transmitted thereto and, after delivery of the job output to Bin 5, the corresponding user is notified with the controller (step 254) that the job output resides therein. If no Private bins are available, then the controller continues the search to determine if any Semi-private bins are available. If a Semi-private bin is found, then prints are delivered thereto and, via step 254, the user is notified of delivery location. If no Semi-private bin is available, then the prints are delivered to a Public bin and the user is notified of the delivery location. In the illustrated embodiment of FIG. 6, open private bins are assigned to users prior to Semi-private bins and Semi-private bins are assigned prior to Public bins so as to optimize space in the public bins; however, in another embodiment public bins could be assigned prior to Semi-private bins and so on.

Figure 8:
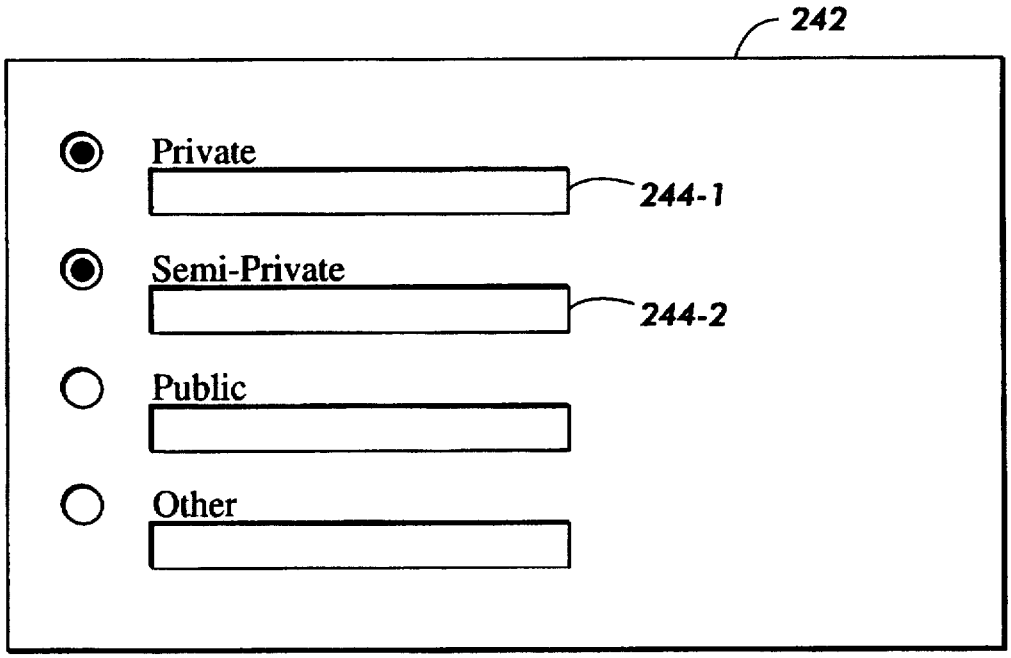

Referring again to step 250, if a request includes a preference as to print delivery, then a preference statement is read at step 260. A preference statement can assume at least one of three forms. Referring to the first form, with the dialog 242 of FIG. 7, a user may indicate that s/he wishes to deliver prints to one of either one, two or three different types of bins, i.e. the user may specify a delivery range. In the example of FIG. 8, a user has designated that the delivery range is to include Private and Semi-private bins. A search is then performed, via step 262, to determine whether a bin is available within the designated delivery range. If a bin in the delivery range is available, then delivery of output is achieved at step 264; otherwise, the user is provided with an opportunity, via step 266 and 268 to adjust the request. In the example of FIG. 8, upon learning that only Public bins are available, the user may wish to change the delivery range to Public and, shortly thereafter, visit the printer to avoid having the corresponding output mixed up with other output.

Figure 9:
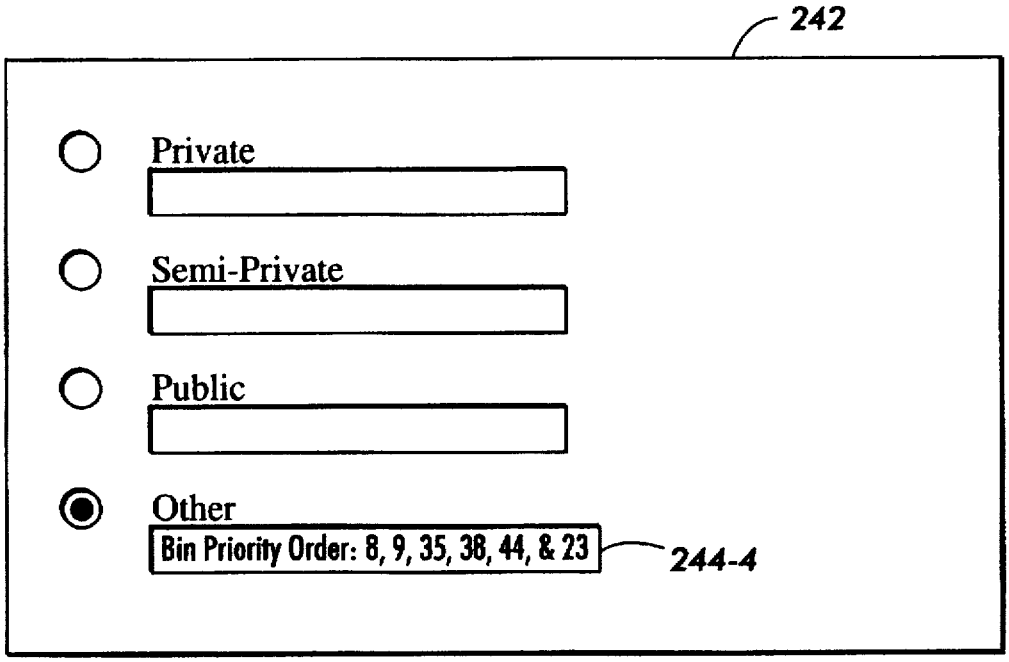

Referring to the second form of the preference statement, a user may provide a preference list by use of the Other designation. This approach is best understood by reference to an example: In a 56 bin mailbox bin subsystem, John has Private bins (#s 7, 8 and 9) and four Shared bins (#s 23, 35, 38 and 44) to which he has access—bin #9 is secured by an electronic lock while each of the other bins are nonsecured. When John sends a secure job, he specifies a preference list of "9, 7 and 8" in the input/display area 244-1 (FIG. 7). On the other hand, for non-secure jobs a bin preference list of "8, 9, 35, 38, 44 and 23" is provided in the area 244-4 of FIG. 9. In the example of FIG. 9, the user enables a priority list by providing a recognized phrase, e.g. "Bin Priority Order" and following the phrase with bins that s/he owns.

Referring to the third form of the preference statement, it should be noted that use of a preference list can greatly facilitate the distribution of a job among a wide range of recipients. For instance, referring again to the example discussed immediately above, John may wish to deliver a copy of job output to himself as well as to each group with whom he shares bins 23, 35, 38 and 44. To enable this, he would type in area 244-4: "Distribute copy(ies) to: (7, 8 or 9) and ( 23, 35, 38 and 44)". In this way an output copy would be delivered to one of John's bins and to each of bins 23, 35, 38 and 44. It is further contemplated that multiple copies could be transmitted to each of the bins designated in the distribution list.

Figure 11:
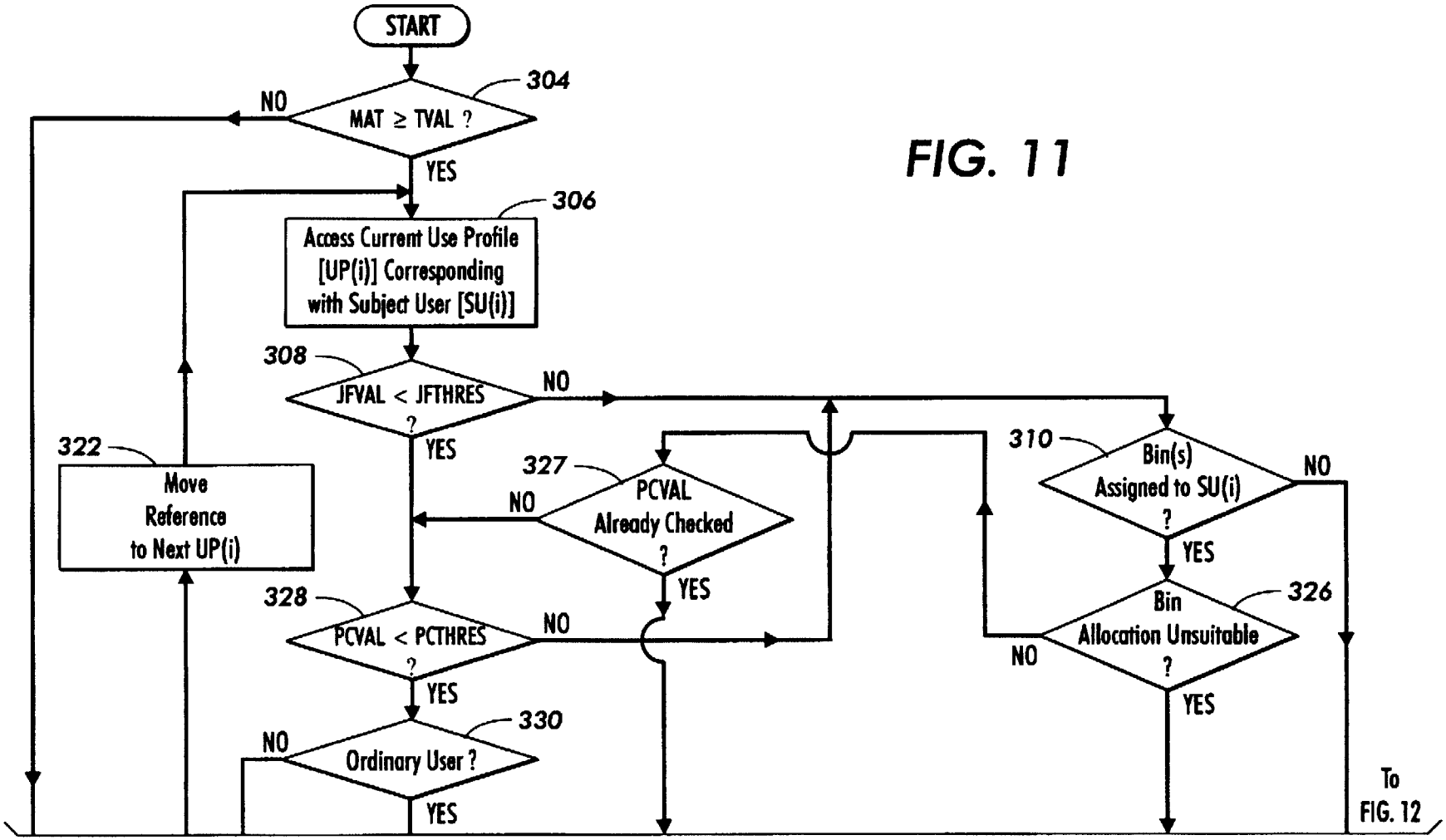
FIGS. 11 and 12 comprise a flow diagram representing a technique for use with a print receiving bin set in which the correspondence of print receiving bins to bin set users can be adjusted when usage of the print receiving bin set fluctuates from an accepted norm.
Figure 12:
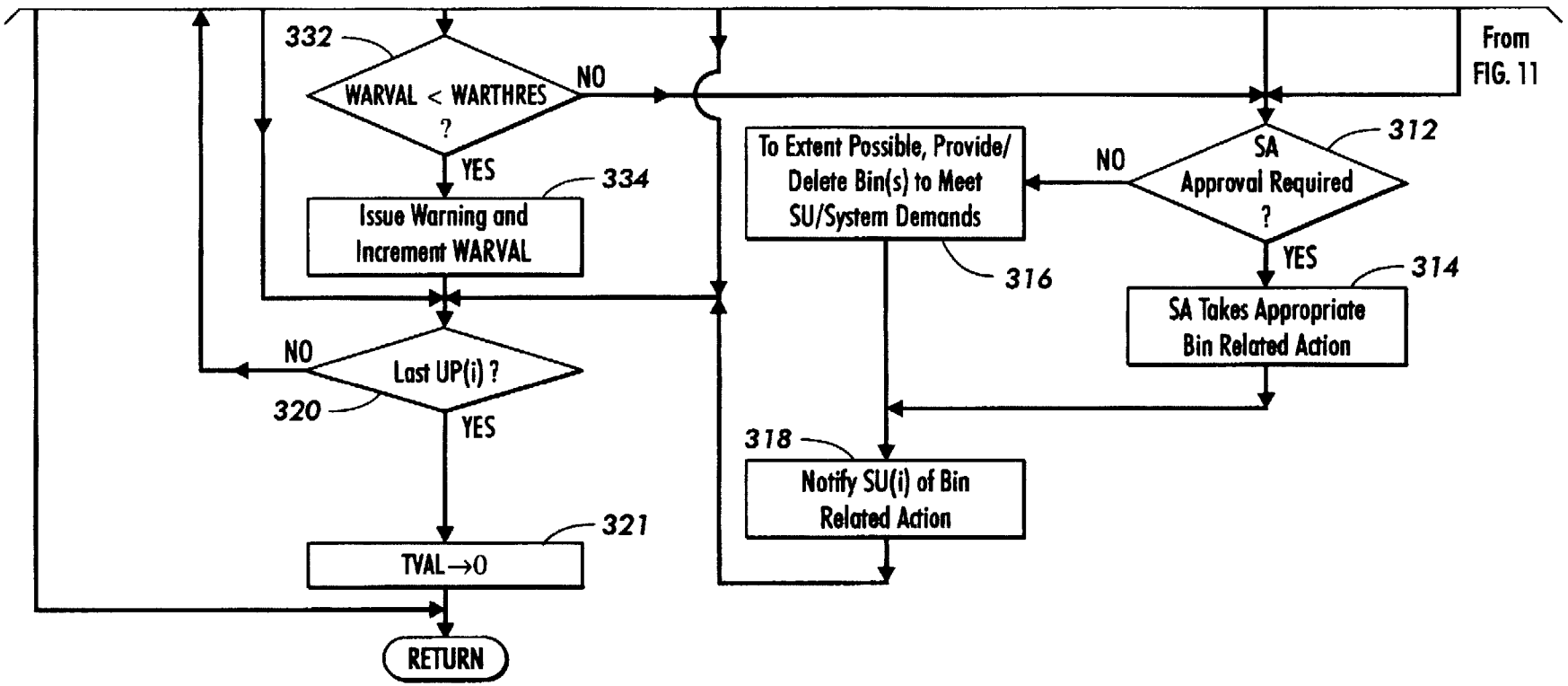

Referring to FIGS. 10–12, a technique for automatically/semi-automatically corresponding print receiving bins (FIG. 1) with bin users is discussed. In the preferred embodiment, a use profile for each user of the mailboxing system of FIG. 1 is, as shown in FIG. 10, maintained in a suitable table 300, the table 300 representing a window into an appropriate database. In part, the database 300 includes a line for each user in which the user's name is corresponded with one or more print receiving bins. Other information regarding frequency of use, the significance of which is discussed below, is maintained in the database. Additionally, database 300 is, in one example, displayed on a screen 302 of a suitable workstation, such as one of the workstations 15 of FIG. 2.

Referring to FIG. 11, after a given time period has elapsed, e.g. two weeks, the profile of each user is examined to determine if the current bin allocation or assignment for the user is still suitable. In particular, a record of the time that has elapsed since the database has been examined is kept by way of "TVAL". Periodically, TVAL is compared with a mailbox activity threshold "MAT" (step 304) and when WKVAL is greater than or equal to MAT, each profile in the database table 300 is examined. While the value of MAT is, in the present example, two weeks, it is understood that the value of MAT would preferably vary in accordance with a variety of factors, such as the amount of use to which the mailbox bin subsystem is subjected within a given time period.

Assuming that it is time to examine use profiles a first profile corresponding with a subject user, e.g user profile no. 1 of subject user 1 or "UP(1) of SU(1)", is accessed at step 306. A job frequency value ("JFVAL") is then, at step 308 compared with a job frequency threshold ("JFTHRES"). Updated records for the mailbox activity period are maintained in the database for JFVAL and PCVAL. That is, each time a job or sheet is delivered to a mailbox bin associated with a subject user, the entry for SU(i) corresponding with that user is updated. Once the activity period has elapsed, an analysis of JFVAL and/or PCVAL is performed in accordance with the technique of s 11 and 12.

In at least one example, a suitable value of JFTHRES is obtained for each user by reference to a matrix of the kind represented by matrix 309 (FIG. 10). As illustrated by matrix 309, each Threshold value in the matrix varies as a function of bin number and exclusivity of use, the exclusivity being designated in descending order of priority from Level 1 to Level N. The matrix 309 includes values for page count thresholds ("PCTHRES"), i.e., how many pages are delivered to the one or more bins assigned to a given user within a selected period of time e.g., two weeks; however, desirably, a matrix for JFTHRES would also be maintained in the system.

Preferably, a JFTHRES value and a PCTHRES is assigned to each subject user and stored in the database 300. It will be appreciated that threshold values for individual users may require updating over time to reflect the changing needs of those users. Additionally, the threshold for a given user may be reduced as a reflection of a status of the user. For example, a special guest user may be assigned a PCTHRES of 30 for a single level 1 bin. Essentially, the special guest user has been provided with a "handicap" as player of golf might be. In this way, as will appear from the discussion of FIGS. 11 and 12 below, the special guest can obtain use of a Private bin even when his/her PCVAL is less than a normal PCTHRES.

A few observations regarding the matrix are in order. First, the thresholds for more exclusive bins are maintained at a level that is significantly greater than thresholds for less exclusive bins. For instance, to obtain a level 1 bin (preferably a private bin) requires a PCTHRES of 60 while obtaining a less exclusive level 2 bin (preferably a shared or conditioned bin), a PCTHRES of only 30 is required. Second, an increase from two to three bins at level 1 requires a 50% jump in sheet output (i.e., a jump from 80 to 120) while a comparable bin increase at level 2 requires a 37% jump in sheet output (i.e. a jump from 41 to 56). Indeed, for the illustrated embodiment of FIG. 10, the jumps for level 2 bins are generally flat or linear, across the line for level 2, while the jumps for level 1 are geometric so as to be "stingy" with respect to allocation of level 1 bins beyond a certain bin number. It follows that the jump in threshold value between 3 bins to 4 bins, for level 1, would be even greater than 50%.

Finally, as will be discussed in further detail below, the threshold values of the matrix can be used to form composite threshold values to account for the assignment of multiple bins to a given user. It is contemplated that the matrix could assume the form of a look-up table of composite threshold values. Accordingly, in one example, a look-up table of composite PCTHRES values might include the following entry:

2 Bins (Level 1) and 1 Bin (Level 2) 110 Sheets

Referring again to step 308 of FIG. 11, if JFVAL is greater than or equal to JFTHRES, then the entry of the database 300 (FIG. 10) for the current subject user (i.e. the user whose profile is currently being scrutinized) is further examined, at step 310, to determine what, if any bins, are assigned to that subject user. If no bins are assigned to the subject user, then a decision is made as to whether one or more bins are to be assigned to the subject user. This decision can either be made by an authorized user (e.g. system administrator (SA)) (step 312) (FIG. 12) or automatically. For the situation in which the decision is made by the SA, the SA can either grant or refuse assignment/allocation of one or more bins to the subject user (step 314).

For the situation in which assignment/allocation is automatically initiated, the subject user will, via step 316, to an extent possible, be provided with as many bins as necessary to meet the subject user's demands. It should be appreciated there is a bias in the system toward providing users with bins whenever their delivery of output warrants such provision. Whether the bin assignment/allocation approach is SA or automatically driven, the subject user is notified, via step 318, of any bin related action taken. Subsequently, the process moves to step 320 (FIG. 12) where a determination as to whether each use profile has been examined is made. If UP(i) constitutes the last line of the database 300, then the process returns and eventually makes a check at step 304 (FIG. 11) to determine if the process is to be performed again; otherwise, a reference or pointer is moved in the database (step 322) and another UP(i) is considered at step 306. It should be noted that if the UP(i) corresponds with the last user profile in the database, then TVAL is set at 0 (step 321) to reset the process.

Referring again to the determination of step 310, if the subject user is assigned or owns one or more bins, i.e., the subject user has a current assignment of one or more bins, then a determination is made, at step 326 as to the suitability of such current assignment. If the allocation is suitable, then the process moves to a check 327 to determine if an analysis of PCVAL has been performed. If the analysis has not been performed then the process moves to step 328; otherwise, the process loops to step 320 (FIG. 12) where a check to determine if the last user profile has been considered is performed.

If PCVAL is greater than or equal to PCTHRES, then the process moves to step 310 (FIG. 11) where the subroutine for determining whether the subject user is entitled to more bins is initiated. It will be understood that the procedure for analyzing the situation in which PCVAL is greater than or equal to PCTHRES is equivalent to the procedure for analyzing the situation in which JFVAL is greater than or equal to JFTHRES. Additionally, while a user can obtain another bin if either of query 308 OR 328 is answered in the negative, the process contemplates a scenario in which the bin adding routine beginning at step 310 can only be accessed if both queries 308 AND 328 are answered in the negative.

For the situation in which the subject user is using his/her bins at a subthreshold frequency, the user may be issued a warning regarding a potential adjustment of current assignment. Before proceeding with the warning subroutine, however, a check is performed, at step 330 to determine whether the subject user is an "immune" user, i.e., whether the user maintains his/her current assignment, notwithstanding use over the activity period. It will be appreciated that a special user with a handicap, of the kind mentioned above, is different from a special user in that the special user with the handicap can lose bins, provided JPVAL and PCVAL fall below acceptable frequency threshold, while the immune user cannot.

Referring to FIG. 12, assuming that the subject user's use of the bins falls below acceptable frequency thresholds and the subject user is not an immune user, then a check to see if "WARVAL" (the number of warnings given in a selected time interval), is less than a warning number threshold, namely WARTHRES, is made at step 332. If WARVAL is greater than or equal to WARTHRES then the process is directed toward step 312 to determine whether a suitable action is to taken by the SA or automatically. In either case, it is contemplated that a revision of current bin assignment will be taken when the subject user's use of assigned bins drops below acceptable threshold levels. On the other hand, if WARVAL is less than WARTHRES, then a warning is issued (step 334) and a notice is sent to the subject user apprising the user of the possibility of bin loss in the future.

To more fully understand the operation of the technique of FIGS. 11 and 12, reference is made to the following examples:

Example 1: For UP(1) of "John", JFV[AL]=23 and the value of the composite JFT[HRES] for two level 1 bins, in one example is 20. Accordingly, John is assigned private bins 11 and 14. It does not matter, for purposes of the illustrated process of FIGS. 11 and 12, that PCV[AL] is greater than PCT[HRES] since the subject user's frequency of use exceeds the frequency threshold.

Example 2: For UP(2) of "Jane", JFV[AL]=21 and the value of the composite JFT[HRES] for three level 1 bins is 30. Accordingly, under the test of step 308 (FIG. 11), Jane's frequency of usage would not warrant an assignment of three level 1 bins. In the past, Jane has generally maintained three level 1 bins by exceeding a PCT[HRES] of 110. In the illustrated example of FIG. 10, however, Jane's current use is below 120. Thus, a check is made to determine how many warnings Jane has received. Since Jane has already received a warning ("Warn."=1) and the system WARTHRES is equal to a value of two, Jane's assignment is altered from three level 1 bins to a combination of two level 1 bins (PCTHRES=80) and a shared bin (PCTHRES=31), assuming, of course, that Jane has expressed previously a willingness to share a semi-private bin with others. It will be recognized that Jane may indicate an unwillingness to use a semi-private bin, in which event, the system might either permit Jane to keep her current assignment, assuming that the system is not overloaded with requests for level 1 bins, or simply relegate Jane to an assignment of two level 1 bins.

Example 3: Don is a special user provided with a handicap of 30. Thus, his PCTHRES of 30 permits him to obtain an assignment of a single level 1 bin. Sam, is an immune user who has been assigned a single level 1 bin. No value is provided for either JFT or PCT since Sam's bin(s) remains with Sam until the SA decides to remove such bin(s) from Sam's current assignment.

Figure 13:
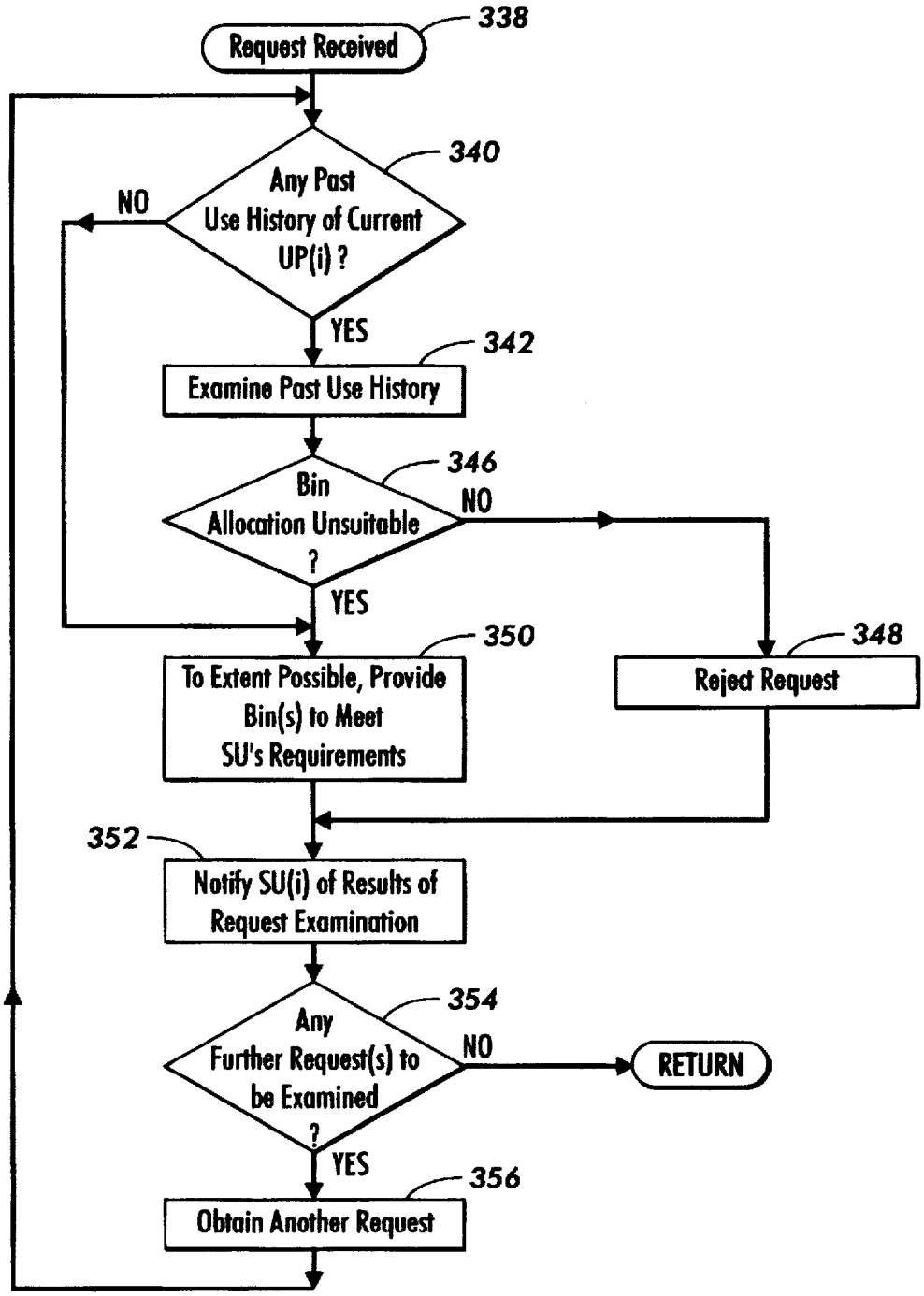
FIG. 13 is a flow diagram representing a technique for selectively changing a user's current bin assignment, in a mailbox bin subsystem, on the basis of a request.

Referring to FIG. 13, a technique for requesting a bin, by a subject user (SU(i)) is discussed. As will be appreciated, requests are typically submitted by way of a suitable user interface from, for example, a workstation or printing machine and buffered at a local or remote memory site. In the illustrated embodiment of FIG. 13, the controller 100 (FIG. 1) receives a first request (step 338) and the controller, in response to such receiving, determines, at step 340, whether the user has a past history. In one approach, a user is always considered to have a current assignment of bins even if the number of assigned bins is zero; however, a user cannot have a past history unless such user has actually had a bin assigned to him/her for a single recorded time interval ("t").

Assuming, the user has a past history, an examination of the history is made, at step 342. In one example, a past use history is maintained in a database 344 (FIG. 10) and examination of the past history is made by the SA. As will appear to those skilled in the art, nonetheless, it will be readily apparent that the intelligence level required for the examination is not all that great, so the examination can be automated without undue difficulty and/or experimentation. If the bin allocation, in view of the history, is suitable (see generally, step 346) and thus need not be increased, then a rejection is issued at step 348. If, on the other hand, the subject user has no past history (i.e., the answer to the query of 340 was negative) or needs one or bins to meet his/her current use needs, then one or more bins are, to the extent possible, provided by way of step 350.

Whether a request is rejected or at least in part granted, a notice (step 352) regarding the results of the request examination are provided to the user. A determination is made, at step 354, as to whether another request is to be examined. If another request is pending, then the buffered request is obtained (step 356) and the above-described procedure of request examination is repeated.

To more fully understand the operation of the technique of FIG. 13, reference is made to the following example:

Over a six week period, the user corresponding with UP(4) (see database 344 of FIG. 10) has been increasing his/her sheet count delivery total (i.e., magnitude of PCVAL) steadily. It appears, from a pattern developed over the six weeks, that a request for three level 1 bins should be granted. It should be noted that the system does not preferably increase the user's assignment to two private and two semi-private bins since to do so would be less direct than to simply alter the assignment to three level 1 bins. There is a bias in the system to assign in terms of bigger units rather than smaller units so that the user is burdened with less rather than more bins. This is a bit similar to making change for a cash bill in that a user is preferably provided with two quarters instead of one quarter, two dimes and a nickel.

Numerous features of the above-described embodiment will be appreciated by those skilled in the art:

First, a system for reassigning one or more print receiving bins to a user on the basis of frequency of use is provided. In one approach a frequency of use value is developed, to reflect the extent to which the user is using the bins, and when that value drops below a given threshold, a reassignment is made either semi-automatically, by a system administrator, or automatically with a suitably programmed controller. In the one approach, the threshold is based on either the number of jobs delivered to the user's bin(s) within a selected time interval or the number of sheets delivered to the same bin(s) in the selected time interval. As contemplated, the threshold may accommodate for a level of exclusivity, relative to use, of one or more bins and/or the status of a user, e.g., a threshold can be set at a lower level for less exclusive bins or a special user.

Second, a system for maximizing management convenience is provided. In particular, values reflecting frequency of use as well as appropriate threshold values can be maintained in a database. Moreover, threshold values for a host of assignment situations can be provided in a matrix or look-up table thus minimizing the amount of system administrator determination required in obtaining threshold values corresponding with the assignment of one or more bins. Finally, the database management system facilitates a warning system in which a user is apprised of his/her failure to optimize usage of one or more bins to which the user is assigned.

Finally, a system optimizing bin requests is provided. In one approach, one or more bins can be assigned on the basis of a past use history. For example, a user may request the change of a bin assignment from a semi-private bin to a private bin. By simple reference to a corresponding past use history, a system administrator can readily determine whether an addition of one or more bins is appropriate. Managing assignment in this manner is particularly useful in a system with many bins having varying levels of exclusivity, relative to use.

What is claimed is:

1. In a sheet handling system having a mailboxing system with a mailbox bin subsystem, the mailbox bin subsystem including a print receiving bin set with a plurality of print receiving bins, the plurality of print receiving bins being corresponded with a set of bin users, a control system comprising:

(a) a user interface with which one or more print receiving bins of the plurality of print receiving bins is assigned to one of the bin set users; and (c) a controller communicating with the mailbox bin subsystem, said controller:

(i) determining, for the one bin set user, a frequency of use value varying as a function of a degree to which the one bin set user uses the one or more print receiving bins to which the one bin set user is assigned, and (ii) reassigning one of the one or more print receiving bins to which the one bin set user is assigned when the frequency of use value drops below a preselected threshold and a selected condition is met.

2. The control system of claim 1, wherein the preselected threshold is selected from one of a first threshold and a second threshold.

3. The control system of claim 2, wherein each of the first and second thresholds vary as a function of a number of print receiving bins and a level of exclusivity corresponding with the number.

4. The control system of claim 1, wherein the frequency use value is stored in a database.

5. The control system of claim 1, in which a plurality of document jobs are delivered to the one or more assigned bins over a selected time interval, wherein the frequency of use value is determined on a basis of the number of document jobs delivered to the one or more assigned bins within the selected time interval.

6. The control system of claim 1, in which a plurality of sheets are delivered to the one or more assigned bins over a selected time interval, wherein the frequency of use value is determined on a basis of the number of sheets delivered to the one or more assigned bins within the selected time interval.

7. The control system of claim 1, wherein a warning of possible bin reassignment is provided to the one bin set user whenever it is determined that the frequency of use value is below the preselected threshold and a number of warnings previously provided to the user has not exceeded a preselected warning reference.

8. The control system of claim 7, wherein the selected condition is met when the number of warnings exceeds the preselected reference.

9. In a sheet handling system having a mailboxing system in which a controller communicates with a mailbox bin subsystem including a print receiving bin set with a plurality of print receiving bins, the plurality of print receiving bins being corresponded with a set of bin users, a method of adjusting the correspondence of print receiving bins to bin set users when usage of the print receiving bin set fluctuates from an accepted norm, comprising:

(a) assigning one or more print receiving bins of the plurality of print receiving bins to one of the bin set users;

(b) determining, for the one bin set user, a frequency of use value varying as a function of a degree to which the one bin set user uses the one or more print receiving bins to which the one bin set user is assigned;

(c) reassigning one of the one or more print receiving bins to which the one bin set user is assigned when the frequency of use value drops below a preselected threshold and a selected condition is met.

10. The method of claim 9, in which the print receiving bin set includes a first subset of print receiving bins having a first level of exclusivity, with respect to use, and a second subset of print receiving bins having a second level of exclusivity, with respect to use, and in which the first level of exclusivity is greater than the second level of exclusivity, wherein said (a) includes assigning one of the bins in the first subset of print receiving bins to the one bin set user.

11. The method of claim 10, further comprising selecting the preselected threshold from one of a first threshold and a second threshold.

12. The method of claim 11, further comprising configuring the first threshold so that it varies as a function of the first level of exclusivity and configuring the second threshold so that it varies as a function of the second level of exclusivity.

13. The method of claim 10, wherein said (a) includes assigning one of the bins in the second subset of print receiving bins to the one bin set user.

14. The method of claim 10, further comprising configuring the preselected threshold so that it varies as a function of both the first level of exclusivity and the second level of exclusivity.

15. The method of claim 9, further comprising selecting the preselected threshold from a table of predetermined thresholds in which each predetermined threshold varies as a function of both a number of print receiving bins and a level of exclusivity corresponding with the number.

16. The method of claim 9, further comprising storing the frequency of use value in a database.

17. The method of claim 9, further comprising performing both said (b) and (c) at a first time and a second time, wherein a time interval between the first and second times is chosen so that the frequency of use value is sufficiently representative of the degree to which the one bin set user is using the one or more print receiving bins.

18. The method of claim 9, in which a plurality of document jobs are delivered to the one or more assigned bins over a selected time interval, wherein said (b) includes determining the frequency of use value on a basis of the number of document jobs delivered to the one or more assigned bins within the selected time interval.

19. The method of claim 9, in which a plurality of sheets are delivered to the one or more assigned bins over a selected time interval, wherein said (b) includes determining the frequency of use value on a basis of the number of sheets delivered to the one or more assigned bins within the selected time interval.

20. The method of claim 9, further comprising warning the one bin set user of possible bin reassignment whenever it is determined that the frequency of use value is below the preselected threshold.

21. The method of claim 20, wherein said (c) includes concluding that the selected condition has been met when the number of warnings exceeds a preselected reference.

22. The method of claim 9, further comprising prohibiting said reassigning when the one bin set user is a special user whose assignment to the one of the one or more print receiving bins is indefinitely irrevocable.

23. The method of claim 9, further comprising prohibiting said reassigning until an approval by an authorized system user has been obtained.

24. The method of claim 9, further comprising adjusting a magnitude of the preselected threshold on a basis that the one bin set user is a special bin set user.

25. In a sheet handling system having a mailboxing system in which a controller communicates with a mailbox bin subsystem including a print receiving bin set with a plurality of print receiving bins, a user having a current assignment in which the user is assigned zero or more of the plurality of print receiving bins, a past use history being generated when the user delivers one or more prints to one or more of the plurality of bins within a selected past time interval, a method of selectively changing the user's current assignment on the basis of a request communicated to the controller, comprising:

(a) receiving the request at and reading the request with the controller:

(b) in response to said reading of (a), obtaining a past use history for the user when a past use history already exists for the user;

(c) when said past use history exists, examining the past use history to determine whether the past use history includes a pattern, based on frequency of use, suggesting that a change in the user's current assignment of print receiving bins is warranted; and (d) when said pattern suggests that a change in the user's current assignment of print receiving bins is warranted, changing the user's current assignment.

26. The method of claim 25, further comprising configuring the past history so that a first set of information regarding bin assignment for the user is provided at a first time and a second set of information regarding bin assignment for the user is provided at a second time.

27. The method of claim 26, further comprising separating the first time from the second time by at least 24 hours.

28. The method of claim 25, further comprising configuring the past history so that a first set of information regarding frequency of use for the user is provided at a first time and a second set of information regarding frequency of use for the user is provided at a second time.

29. The method of claim 28, further comprising separating the first time from the second time by at least 24 hours.

30. The method of claim 25, in which the print receiving bin set includes a first subset of print receiving bins having a first level of exclusivity, with respect to use, and a second subset of print receiving bins having a second level of exclusivity, with respect to use, further comprising providing the past use history with information regarding frequency of use for at least one print receiving bin in each of the first and second subsets of print receiving bins.

31. The method of claim 25, wherein said (c) and (d) are performed exclusively by an authorized system user.

32. The method of claim 25, in which no past use history exists for the user, changing the user's current assignment so that the user is assigned at least one print receiving bin.

* * * * *

UNITED STATES PATENT AND TRADEMARK OFFICE

CERTIFICATE OF CORRECTION

PATENT NO. : 5,777,882

DATED : July 7, 1998

INVENTOR(S) : David L. Salgado

It is certified that error appears in the above-identified patent and that said Letters Patent is hereby corrected as shown below:

On the title page, Item [54], and Column 1,
Change title to read --Printer Mailbox Control System Based on Frequency of Use--.
Col. 1, line 3, delete "D/95381" and insert --08/721,513 & 08/876,916--.
Column 1, line 7, delete "(Attorney's Docket No. 95381)" and insert --721,513--.

Column 1, line 9, delete "(Attorney's Docket No. 96440)" and insert --876,916--.

lines 10-13, delete "both of which applications are attributable to the same Applicants as the Present Application, and both of which applications were filed on the same day as the Present Application".

Column 2, lines 64 and 65, delete "and D/91519 and D/92247 noted immediately above".

Column 3, line 17, delete "5,012,892" and insert --5,021,892--.

Column 3, line 49, delete "Cannon" and insert --Canon--.

Colunm 20, line 18, delete "(c)" and insert --(b)--

Signed and Sealed this

Third Day of August, 1999

*Attest:*

Q. TODD DICKINSON

*Attesting Officer*

*Acting Commissioner of Patents and Trademarks*